US006743072B2

(12) United States Patent
Nelson et al.

(10) Patent No.: US 6,743,072 B2
(45) **Date of Patent: *Jun. 1, 2004**

(54) WHIRLING AMUSEMENT DEVICE AND ASSOCIATED METHOD OF OPERATION

(76) Inventors: Webb T. Nelson, 19180 144th Ave., Woodinville, PA (US) 19067; Patrick J. Turner, 2107 25th Ave. SE., Puyallup, WA (US) 98374

( * ) Notice: Subject to any disclaimer, the term of this patent is extended or adjusted under 35 U.S.C. 154(b) by 0 days.

This patent is subject to a terminal disclaimer.

(21) Appl. No.: 10/404,778

(22) Filed: Mar. 31, 2003

(65) Prior Publication Data

US 2003/0190859 A1 Oct. 9, 2003

Related U.S. Application Data

(63) Continuation-in-part of application No. 09/811,750, filed on Mar. 19, 2001, now abandoned, which is a continuation-in-part of application No. 09/383,914, filed on Aug. 26, 1999, now Pat. No. 6,227,929.

(51) Int. Cl.[7] ..... A63H 11/02

(52) U.S. Cl. ..... 446/490; 446/358; 446/239; 446/236; 40/414; 119/707; 119/708

(58) Field of Search ..... 446/266, 175, 446/236, 358, 361, 366, 437, 462, 490, 239; 119/707, 708; 40/414

(56) References Cited

U.S. PATENT DOCUMENTS

| | | | | | |
|---|---|---|---|---|---|
| 3,545,126 | A | * | 12/1970 | Brown | 446/236 |
| 5,146,702 | A | * | 9/1992 | Belokin, Jr. | 40/430 |
| 5,823,844 | A | * | 10/1998 | Markowitz | 446/175 |
| 6,227,929 | B1 | * | 5/2001 | Nelson et al. | 446/239 |
| 6,345,593 | B1 | * | 2/2002 | Stewart et al. | 119/706 |
| 6,629,510 | B1 | * | 10/2003 | Robkin | 119/707 |
| 2003/0124950 | A1 | * | 7/2003 | Turner | |

* cited by examiner

*Primary Examiner*—Derris H. Banks
*Assistant Examiner*—Dmitry Suhol
(74) *Attorney, Agent, or Firm*—LaMorte & Associates

(57) ABSTRACT

An amusement device used to move a supported display object through an erratic path. The amusement device includes a base element in which is disposed a motorized assembly. A support spring is used to interconnect a display object to the motorized assembly in the base element. The support spring has a first end and a second end. The first end of the support spring is coupled to the motorized assembly within the base element, wherein the support spring is caused to move by the vibrating assembly. The remainder of the support spring extends freely from the base element. The display object is coupled to the second end of the support spring. As the display object moves, it causes the support spring to oscillate, thereby causing the display object to move erratically from point to point

13 Claims, 4 Drawing Sheets

WHIRLING AMUSEMENT DEVICE AND ASSOCIATED METHOD OF OPERATION

RELATED APPLICATIONS

This application is a Continuation-In-Part of U.S. patent application Ser. No. 09/811,750, entitled Whirling Amusement Device And Associated Method Of Operation, filed Mar. 19, 2001 now abandoned, which was a Continuation-In-Part of U.S. patent application Ser. No. 09/383,914, entitled Whirling Amusement Device And Associated Method Of Operation, filed Aug. 26, 1999 now U.S. Pat. No. 6,227,929.

BACKGROUND OF THE INVENTION

1. Field of the Invention

The present invention relates to amusement devices that contain an object that spins or whirls. More particularly, the present invention relates to amusement devices that contain an object that move erratically, a motor for causing the erratic motion and a flexible shaft disposed between the object and the motor.

2. Description of the Prior Art

The prior art of toys and amusement devices is replete with many examples of objects that spin and whirl. Many such devices are powered by rotational momentum, such as tops and gyroscopes. Other devices are powered by springs, such as windup ballerina figures. Still many other devices utilize battery powered motors to create a spinning motion.

One variation of a battery powered amusement device is when the object being spun is connected to the battery powered motor by a flexible shaft. In such devices, the forces of inertia and centrifugal force cause the flexible shaft to oscillate at the shaft spins. The oscillation of the shaft causes the object being spun to move in an erratic manner. Such prior art devices are exemplified by U.S. Pat. No. 5,146,702 to Belokin, entitled, Display Having An Electric Motor For Simulating A Flying Object; U.S. Pat. No. 4,100,697 to Ward, entitled, Hoop Top; and U.S. Pat. No. 5,823,844 to Markowitz, entitled, Interactive Vibrating Toy.

A limitation associated with such prior art amusement devices is the fact that the length of the flexible shaft is constant. As such, the object supported by the flexible shaft is restrained by the flexible shaft should that object attempt to move away from or closer to the rotating base.

It has been found that an the path followed by a rotating object is far more complex and interesting to observe if the length of the shaft supporting that object is not held constant. It is therefore an object of the present invention to provide an amusement device where an object is held at the end of a rotating flexible shaft that has a variable length. In this manner, the object is free to move both toward and away from its rotating base as part of its erratic movement.

SUMMARY OF THE INVENTION

The present invention is an amusement device used to move a supported display object through an erratic path. The amusement device includes a base element in which is disposed a motorized assembly. The motorized assembly can be battery powered, spring powered or manually powered. A support spring is used to interconnect a display object to the motorized assembly in the base element. The support spring has a first end and a second end. The first end of the support spring is coupled to the motorized assembly within the base element, wherein the support spring is moved by the motorized assembly. The remainder of the support spring extends freely from the base element.

The display object is coupled to the second end of the support spring. As the display object moves, it causes the support spring to at least partially elongate, thereby causing the display object to move erratically from point to point.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Figure 1:
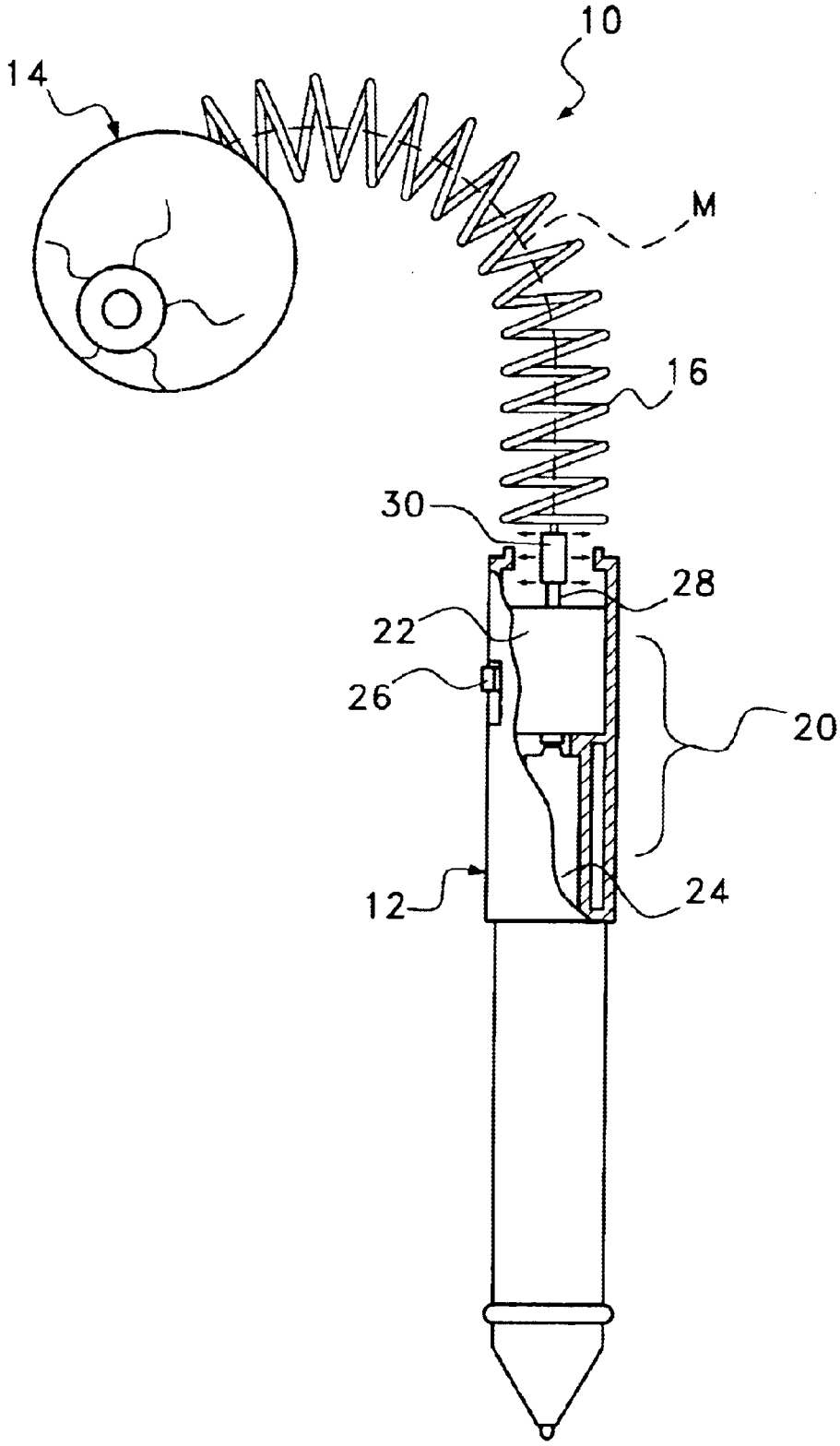
FIG. 1 is a partially fragmented front view of a first embodiment of the present invention amusement device.

Referring to FIG. 1, an exemplary embodiment of the present invention device 10 is shown. The device is comprised of three primary parts, which are a base 12, a display object 14 and a support spring 16 that interconnects the display object 14 to the base 12.

In the shown embodiment, the base 12 is configured as a pen. However, such an embodiment is merely exemplary. The base 12 can be most any hand-held object, such as a plain handle, and need not be a pen. Alternatively, the base 12 can be a self-supporting structure that can rest on a flat surface. As such, it should be understood that the appearance of the base 12 is not important to the functioning of the overall device 10. The base 12 can be dedicated to the function of the overall device 10 or the base 12 can have a secondary purpose outside the functioning of the overall device 10, as does the pen illustrated. Alternate embodiments of the base are later described.

Regardless of the appearance of the base 12, contained within the base is motorized assembly 20. Preferably, the motorized assembly 20 includes a vibrating mechanism 22, a battery 24 for powering the vibrating mechanism 22 and an on/off switch 26 for controlling the operation of the vibrating mechanism 22, as is shown in FIG. 1. However, in alternate embodiments, the motorized assembly 20 can be a spring wound assembly, a flywheel assembly, a manual crank assemble or any other known means for providing a vibrating motion at a predetermined point in an amusement device.

The motorized assembly 20 vibrates the support spring 16 that extends from the base 12 at a predetermined frequency of vibration. The frequency of vibration is sufficient to create oscillations in the support spring 16 while the support spring is attached to the display object 14. Since the vibrational motion caused by the motorized assembly 20 is sufficient to cause visible oscillations in the support spring 16. It is these oscillations that cause the display object 14 to move in an erratic pattern.

In the shown embodiment of the motorized assembly 20, the vibration mechanism 22 vibrates a drive shaft 28. The drive shaft 28 terminates with a connector coupling 30 that can be accessed externally from the base 12. As is shown, the vibration mechanism 22 directly vibrates the connector coupling 30, via the drive shaft 28.

The support spring 16 is coil spring having a relatively low spring constant. The spring constant is selected so that the support spring 16 just reaches full compression when stacked vertically with the weight of the display object 14 aligned vertically at its top. Once the support spring 16 is turned away from a vertical alignment, the weight of the display object 14 bends the support spring 16 and pulls the support spring 16 away from full compression.

The support spring 16 has two ends. One end of coupled to the base 12 and the other end is coupled to the display object 14. The support spring 16 preferably contains at least ten full revolutions between its two ends. The support spring 16, when laid straight, is symmetrically coiled around a mid-line M. The spring constant of the support spring 16 is selected so that when the base 12 is held in a vertical orientation, such as is shown in FIG. 1, the weight of the display object 14 will cause the mid-line M of the support spring 16 to bend between 90 degrees and 180 degrees with respect the vertical. As such, the support spring 16 enables the display object 14 to droop to the side when the base 12 is held in a vertical orientation.

Initially the support spring 16 is coupled to the connector coupling 30 of the motorized assembly 20 so that the mid-line M of the support spring extends vertically above the base 12. The support spring 16 is then bent to the side and out of the vertical by the weight of the display object 14.

As has been stated above, the support spring 16 has two ends. One end of the support spring 16 attaches to the connector coupling 30 in the base 12. A connector may be present at the end of the support spring 16 to facilitate attachment between the support spring 16 and the connector coupling 30.

The opposite end of the support spring 16 terminates with the display object 14. The display object 14 can be either permanently affixed to the support spring 16 or detachable from the support spring 16. A detachable configuration can be used in assemblies where multiple display objects are available and a person selects which of the display objects is placed upon the support spring 16.

The display object 14 can be any item desired. However, since the display object 14 will whirl around in an erratic pattern, it is desired that the display object 14 have no sharp points and be light in weight, so as to prevent injuries if the display object were to inadvertently contact a person's face. An exception to this general design parameter is when a propeller is attached to the support spring as the display object. As a propeller is moved, the propeller creates thrust that acts upon the support spring and adds additional movement to the already erratic path of the display object.

However, in the shown embodiment, the display object 14 is an eyeball made from photoluminescent plastic that enables the eyeball to be viewed in the dark. It will be understood that the display object 14 can be any object, such as an airplane, an insect, a cartoon character or the like. The display object 14 can also be a confection such as a hard candy.

Figure 2:
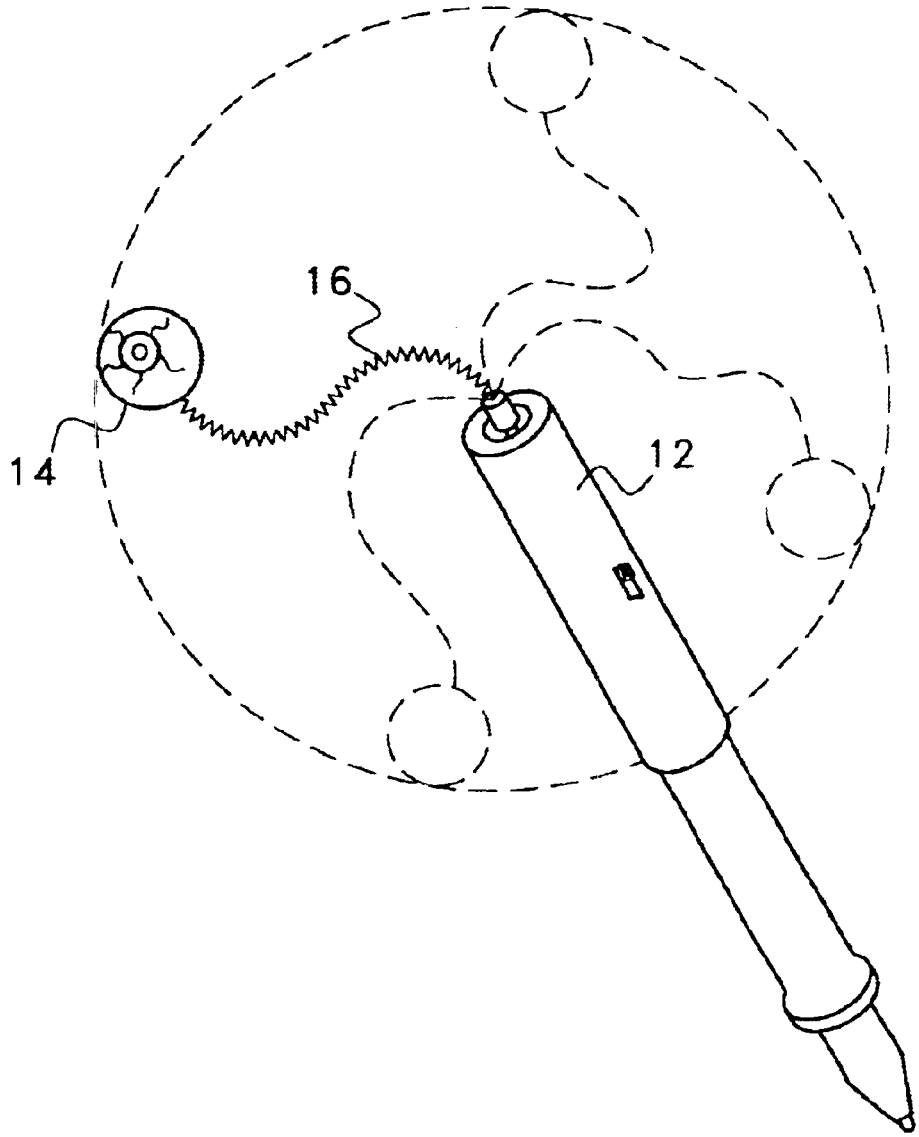
FIG. 2 is a perspective view of the embodiment of the present invention amusement device shown in FIG. 1.

Referring to FIG. 2, it can be seen that the support spring 16 is moved by the vibration mechanism 22 (FIG. 1) in the base 12. During movement, the inertia and centrifugal forces created by the combined mass of the support spring 16 and the display object 14, causes the support spring 16 to elongate and the display object 14 to move erratically. As the display object 14 moves, the support spring 16 stretches and retracts, thereby altering the length of the support spring 16. The forces created by the deformed support spring 16 combine with the inertial and centrifugal forces to rapidly vary the movements of the display object 14.

The display object 14 erratically moves to different points throughout a possible range, which is shown by the circle in FIG. 2. The possible range is spherical in shape and is has a radius equal to the stretched length of the support spring 16. If the forces experienced by the support spring 16 are insufficient to fully extend the support spring 16, the radius of the possible range will decrease to the maximum length at which the support spring is stretched. However, unlike prior art devices, the display object 14 of the present invention doesn't just move around the periphery of the range sphere, rather the coils of the support spring 16 cause the display object to constantly move throughout all points contained within the range sphere.

Figure 3:
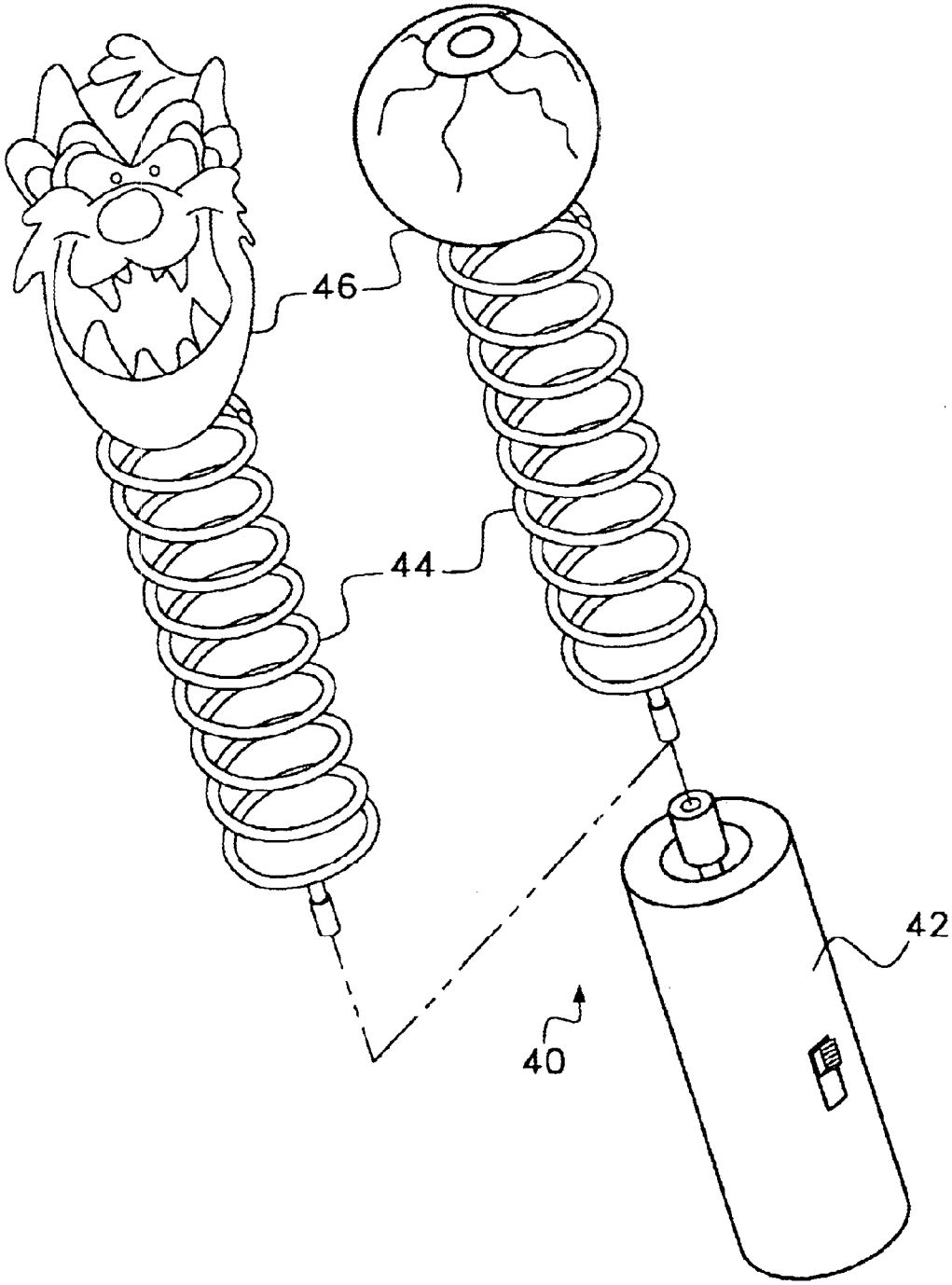
FIG. 3 is a perspective view of an alternate embodiment of the present invention amusement device.

Referring to FIG. 3, a variation of the present invention device 40 is shown. In this embodiment, the base 42 is a self-contained hand-held unit. The base 40 may even be a pre-existing assembly, such as battery operated lollipop holder. Battery operated lollipop holders are exemplified by U.S. Pat. No. 5,209,692 to Coleman, entitled, Combination Novelty Toy And A Candy Holding Device, the disclosure of which is incorporated into this specification by reference.

However, from FIG. 3, it can be seen that multiple support springs 44 and multiple display objects 46 can be supplied. The different support springs 44 can have different lengths, coil diameters and spring constants. As such, each type of support spring 44 will move in its own unique manner. In FIG. 3, one base is shown and two support springs are shown. It will be understood that although multiple support springs can be provided only one support spring at a time is attached to the base.

The display objects 46 also can be come in a variety of sizes and weights. Since size and weight effect the path followed by the display object 46, each type of display object 46 will have its own unique movement characteristics.

Figure 4:
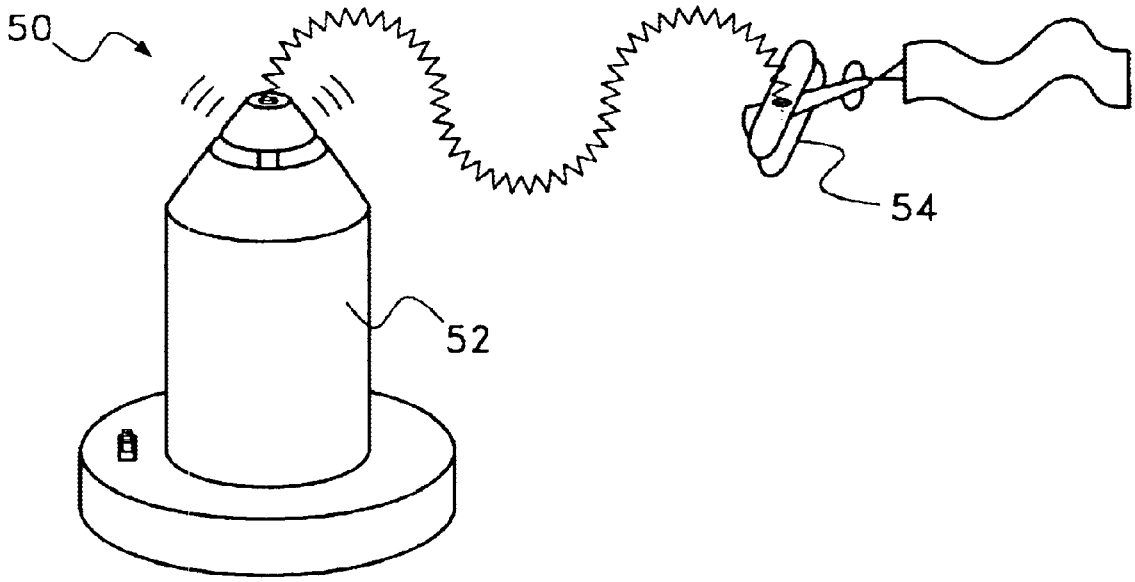
FIG. 4 is a perspective view of third alternate embodiment of the present invention amusement device.

Referring lastly, to FIG. 4, another embodiment of the present invention device 50 is disclosed. In this embodiment, the base 52 is a self-supporting assembly that can rest on a flat surface and does not need to be hand-held. As such, the display object 54 will whirl around the base 52 as the base 52 is left on a surface. Such a configuration can be used as an advertisement promotion to attract the attention of customers. Such a configuration is also useful as part of a game, wherein a whirling display object 54 is used to knock down objects or is used to combat other whirling objects.

It will be understood that the various figures described above illustrate only preferred embodiments of the present invention. Features from the different embodiments can be mixed to produce yet further embodiments. A person skilled in the art can therefore make numerous alterations and modifications to the shown embodiments utilizing functionally equivalent components to those shown and described. All such modifications are intended to be included within the scope of the present invention as defined by the appended claims.

What is claimed is:

1. An amusement device, comprising:

a base element having a motorized assembly therein;

a coil spring having a first end, a second end and at least ten spring revolutions between said first end and said second end, said coil spring being symmetrically disposed around a mid-line that travels through said coil spring, said first end of said coil spring being coupled to said motorized assembly within said base element, wherein and said mid-line of said coil spring initially extends in a vertical orientation up from said base element; and a display object coupled to said second end of said coil spring, wherein said display object has a weight that bends said coil spring, causing said mid-line of said coil spring to turn by at least 90 degrees from said vertical orientation.

2. The device according to claim 1, wherein said motorized assembly includes a vibrating mechanism that vibrates said coil spring at a predetermined frequency.

3. The device according to claim 1, further including an on/off switch accessible on said base element for selectively activating and deactivating said motorized assembly.

4. The device according to claim 1, wherein said first end of said support spring is selectively detachable from said motorized assembly within said base element.

5. The device according to claim 1, wherein said second end of said support spring is selectively detachable from said display object.

6. The device according to claim 1, wherein said display object is photoluminescent.

7. The device according to claim 1, wherein said display object is a confection.

8. The device according to claim 1, wherein said base element has a flat bottom surface and is free standing on said flat bottom surface.

9. A method of imparting erratic movement to an object, comprising the steps of:

providing a coil spring having a first end and a second end, said coil spring being symmetrically disposed around a mid-line that travels through said coil spring;

attaching said second end of said coil spring to a vibrating assembly, wherein said mid-line of said coil spring initially extends in a vertical orientation up from said vibrating assembly;

attaching said object to said first end of said coil spring, wherein said object has a weight that bends said coil spring, causing said mid-line of said coil spring to turn by at least 90 from said vertical orientation; and vibrating said coil spring and said object at a frequency sufficient to cause oscillations in said coil spring.

10. The method according to claim 9, wherein said coil spring has at least ten spring revolutions between said first end and said second end.

11. The method according to claim 9, wherein said vibrating assembly is contained within a hand-held base.

12. An amusement device, comprising:

a battery powered motor;

a coil spring having a first end an a second end, said coil spring being symmetrically disposed around a mid-line that travels through said coil spring, wherein said first end of said coil spring is attached initially in a vertical orientation to said battery powered motor;

a display object coupled to said second end of said coil spring, said display objects having a mass that bends said mid-line of said coil spring at least 90 degrees from said vertical orientation, wherein said battery powered motor causes said coil spring and said display object to move with enough speed to cause oscillations in said coil spring.

13. The device according to claim 12, wherein said battery operated motor is encased in a hand-held base.

* * * * *